US009082374B2

(12) United States Patent
Aires

(10) Patent No.: US 9,082,374 B2
(45) Date of Patent: Jul. 14, 2015

(54) ERGONOMIC GUITAR

(76) Inventor: Daniel Aires, Prairie Village, KS (US)

( * ) Notice: Subject to any disclaimer, the term of this patent is extended or adjusted under 35 U.S.C. 154(b) by 240 days.

(21) Appl. No.: 13/814,572

(22) PCT Filed: Jul. 24, 2012

(86) PCT No.: PCT/US2012/047903

§ 371 (c)(1),
(2), (4) Date: Feb. 6, 2013

(87) PCT Pub. No.: WO2013/016308

PCT Pub. Date: Jan. 31, 2013

(65) Prior Publication Data

US 2013/0139668 A1 Jun. 6, 2013

Related U.S. Application Data

(60) Provisional application No. 61/511,071, filed on Jul. 24, 2011.

(51) Int. Cl.

| | |
|---|---|
| ***G10D 3/00*** | (2006.01) |
| ***G10D 1/08*** | (2006.01) |
| ***G10G 5/00*** | (2006.01) |

(52) U.S. Cl.

CPC ..... *G10D 1/085* (2013.01); *G10G 5/005* (2013.01)

(58) Field of Classification Search

USPC ..... 84/267

See application file for complete search history.

(56) References Cited

U.S. PATENT DOCUMENTS

| | | | | |
|---|---|---|---|---|
| D164,227 | S | 8/1951 | Fender | |
| 2,960,900 | A | 11/1960 | Fender | |
| 5,463,923 | A * | 11/1995 | Kamijyo | 84/291 |
| 5,744,744 | A * | 4/1998 | Wakuda | 84/650 |
| D474,227 | S | 5/2003 | Wilson | |
| 6,703,546 | B1 * | 3/2004 | Wilson | 84/291 |
| 2007/0000370 | A1 * | 1/2007 | Blake | 84/290 |
| 2010/0005942 | A1 * | 1/2010 | Kirkland et al. | 84/267 |

OTHER PUBLICATIONS

Premier Guitar, "2009 Kramer Turbulence", http://www.premierguitar.com/Gear/Guitars/7_String/1760703/Turbulence_R_36.aspx, retrieved on Feb. 6, 2013, pp. 1.

Ministar, "TESTAR", http://ministarguitars.net/id55.html, retrieved on Feb. 6, 2013, pp. 1-2.

(Continued)

*Primary Examiner* — Christopher Uhlir

(74) *Attorney, Agent, or Firm* — David M. Pankros, Attorney at Law

(57) ABSTRACT

An ergonomic electric guitar includes a neck frets, a plurality of strings, and a body. The body includes a bridge having a nominal string anchor point for the strings, an upper bass bout including a front strap attachment mechanism having a front strap attachment point that is disposed within a predefined region. The body also includes a rear strap attachment mechanism having a rear strap attachment point disposed within a predefined region and a lower bass bout including a generally wedge-shaped region disposed between a medial portion of a front face of the lower bass bout and extending to a peripheral side wall of the lower bass bout and the lower bass bout extends substantially beyond a first arc and is substantially within a second arc. The strings extend in a first direction from the bridge to a distal portion of the neck.

3 Claims, 3 Drawing Sheets

(56) References Cited

OTHER PUBLICATIONS

Rees Electric Guitars, "Travel Guitar", http://www.rees-electric-guitars.com/Rambler.html, retrieved on Feb. 6, 2013, pp. 1-2.

Scott French, "06", http://www.scottfrench.com/i/Finished%20Customs/Raj%20Swaminathan's%20SF3%20Travel%20Guitar/06, retrieved on Feb. 6, 2013, pp. 1.

* cited by examiner

ERGONOMIC GUITAR

RELATED APPLICATIONS

This application claims the benefit of U.S. Provisional Application No. 61/511,071, filed 24 Jul. 2011 that is incorporated by specific reference in its entirety herein.

FIELD OF THE INVENTION

This present invention relates to electric guitars. More particularly, the invention relates to conventional-scale-length ergonomic electric guitars.

BACKGROUND

Acoustic guitars have been used for centuries and generally weigh less than 2.25 kg (5 lbs). Acoustic guitars are frequently played seated, while standing with a riser under one foot to support the guitar on a raised leg, or while using a stand for the instrument.

Electric guitars, in contrast, have been used for only the past 60 years. Most electric guitars weigh between 2.75 kg (6 lbs) and 4.5 kg (10 lbs). Despite their increased weight, most guitarists play electric guitars in a standing position with the electric guitar supported by a strap slung over a shoulder of the guitarist.

The combination of the increased weight of an electronic guitar and the standing playing position increases ergonomic stress on the guitarist, particularly the guitarist's joints. Ergonomic stress can cause or exacerbate chronic joint problems and can cause a guitarist to be unable to play, in extreme cases. Various attempts have been made to make an ergonomic guitar but none have been successful at making a comfortable guitar, especially for smaller guitarists.

Some prior art guitars attempt to reduce stress on the joints of the guitarist by reducing the size of the body and using a standard-sized neck, thus reducing weight. In extreme examples, the body of this style of prior art guitar can be nearly as narrow as its neck, providing a stick-like appearance. As a result of the reduced weight in their body, these prior art guitars require the guitarist to use their right wrist to anchor the guitar because they are unbalanced. This prevents elbow-driven strumming altogether and also prevents relaxing the wrist during wrist-driven strumming.

Other prior art guitars reduce weight by carving out chambers in the body of the guitar or by using lighter materials. While reducing weight, these attempts disrupt the balance, change the natural sound of the guitar, and require the guitarist to use their left wrist or right wrist to anchor the guitar.

Yet another attempt to produce an ergonomic guitar involves twisting the neck of the guitar around its longitudinal axis. This reduces, but does not eliminate, stress on a guitarist's left wrist but, in guitars where chords and string-bending are used, twisting can result in the strings buzzing when they strike higher frets in the rotated plane.

Some other prior art guitars have attempted to improve ergonomics in the left shoulder and elbow by reducing the scale length of the guitar's neck. Standard scale lengths vary between 60.96 cm (24 in) and 66.04 cm (26 in), with the majority of electric guitars falling between 62.865 cm (24.75 in) and 64.77 cm (25.5 in), whereas some reduced scale-length guitars have scale lengths between 52.7 cm (20.75 in) and 57.15 cm (22.5 in). This helps to compensate for the balance issues but makes fingering the neck difficult, particularly for adults. Unfortunately, while less left shoulder and left elbow stress may occur, shorter scale lengths increase the stress on the left hand when playing chords due to the closer-spaced frets. Further, reduced scale-length guitars exhibit less-stable intonation and weaker tone, as compared to standard scale-length guitars.

Another prior-art solution to improve balance is relocating the tuners from the headstock of the prior art guitar to the bridge. While this solution can improve balance by bringing weight from the neck to the body of the guitar, it requires alternate methods of fastening and tightening the strings which, in turn, requires non-standard strings and prevents the guitarist from plucking strings with a plucking hand and tuning with the chording hand.

Short-scale guitars and similar instruments, such as ukuleles and mandolins, do not have the same ergonomic difficulties as conventional scale-length guitars because their neck is shorter than a conventional scale-length guitar and, thus, are more balanced.

Longer scale-length bass guitars do not have the same ergonomic challenges because they are generally picked or plucked and not strummed. This playing style allows the picking or plucking hand to be stationary and further support the instrument.

SUMMARY

The present invention solves the above-described problems and provides a distinct advance in the art of ergonomic electric guitars. More particularly, the present invention provides reduced joint stress on the guitarist's left wrist, left elbow, left shoulder, right wrist, right elbow, and right shoulder. This results in a comfortable guitar to play in all playing angles and postures, particularly for smaller guitarists, and further maintains a conventional sound and appearance.

One embodiment of an ergonomic guitar broadly includes a body, a neck, and a string. The body further includes an upper treble bout, a lower treble bout, a bridge, a lower bass bout, and an upper bass bout. The body may further include a front strap attachment mechanism and a rear strap attachment mechanism.

The upper treble bout is rounded and assists in supporting the ergonomic guitar on a knee or thigh of a guitarist. Some embodiments of the upper treble bout may include a fingering relief cut that is a beveled region proximal to the neck to allow easier access to the neck for changing the tone produced by the strings.

The lower treble bout is generally rounded and also assists in supporting the ergonomic guitar on a knee or thigh of a seated guitarist.

The bridge anchors the proximal ends of the strings to the body of the ergonomic guitar. The bridge also includes an anchor point for each string that defines the proximal end of the vibrating length of the string. The average of all the anchor points is the nominal string anchor point.

The lower bass bout is generally rounded and supports the guitarist's right hand when playing. The lower bass bout includes an arm relief that is wedge-shaped region that reduces ergonomic stress on the right hand and right shoulder of the guitarist.

The upper bass bout includes a horn and the front strap attachment mechanism at the distal end of the horn for attaching a front end of a strap thereto at a front strap attachment point. The front strap attachment mechanism is positioned so the front strap attachment point is within reference region C defined by corners D, E, F, and G.

The rear strap attachment mechanism attaches to the lower bass bout or the lower treble bout and secures the rear end of the strap to the body of the ergonomic guitar at a rear strap attachment point. The rear strap attachment mechanism is positioned so the rear strap attachment point is between reference line H and reference line J that are perpendicular to the major axis of the strings and offset 10% of the scale length and 17.64% of the scale length, respectively, from the nominal string anchor point in a direction opposite of the neck. The distance between the front strap attachment point and the rear strap attachment point is generally less than 50.8 cm (20 in).

The neck of the ergonomic guitar is largely conventional but embodiments of the technology may also use non-conventional necks.

Embodiments of the ergonomic guitar reduce ergonomic stress on the left shoulder, left elbow, left wrist, right shoulder, right elbow, and right wrist, especially in smaller guitarists.

Another embodiment of an ergonomic guitar includes tuners integrated into the bridge and utilizes a headpiece to anchor the strings to the distal end of the neck.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
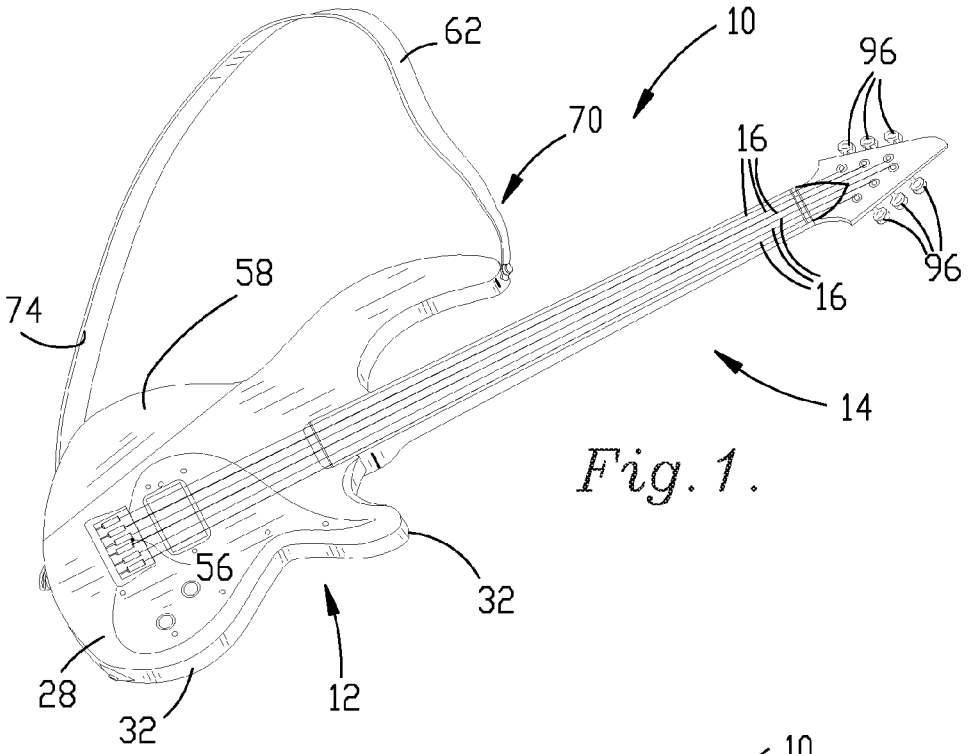
FIG. 1 is a perspective view of a ergonomic guitar constructed in accordance with a first embodiment of the invention.
Figure 2:
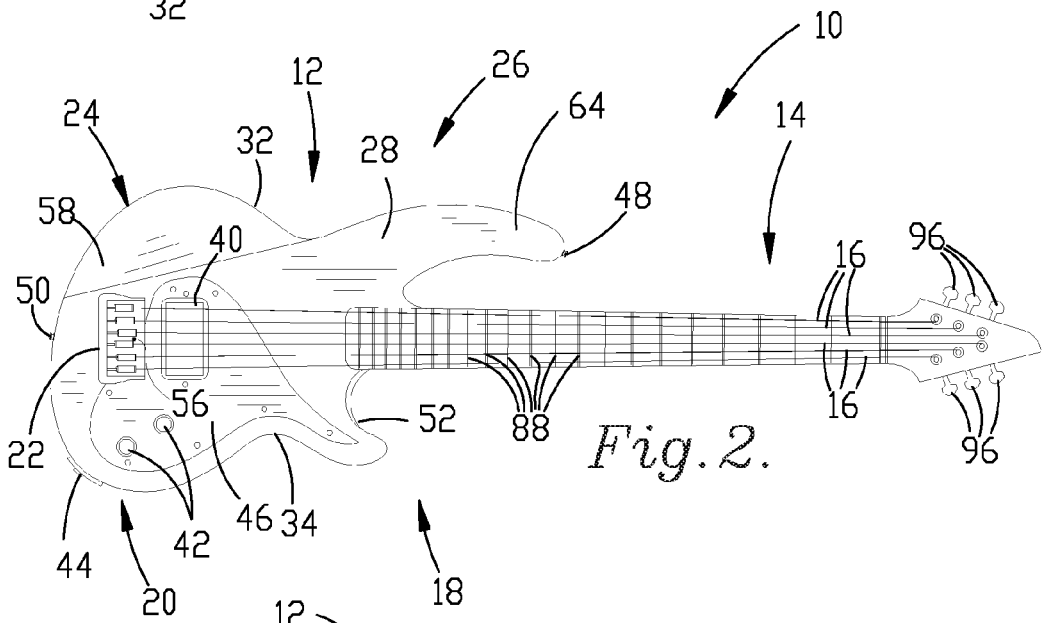
FIG. 2 is a front elevational view of the ergonomic guitar of FIG. 1 showing a body and a neck.
Figure 7:
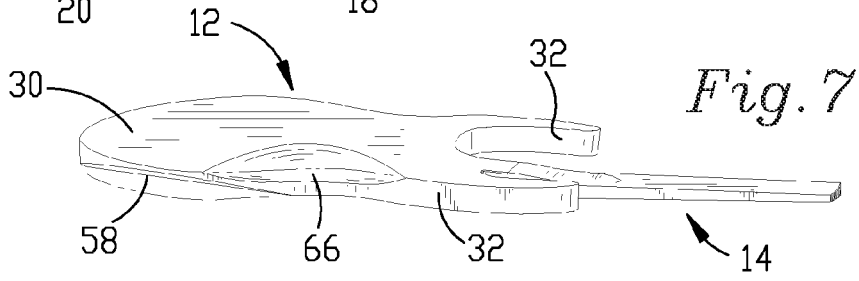
Figure 4A:
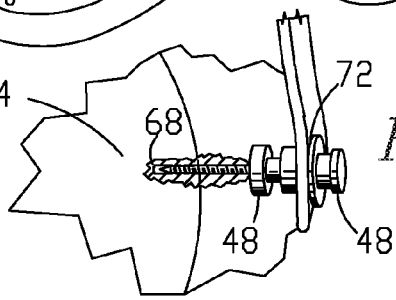
FIG. 4 is a front elevational view of the ergonomic guitar body of FIG. 1 and a strap.
Figure 4:
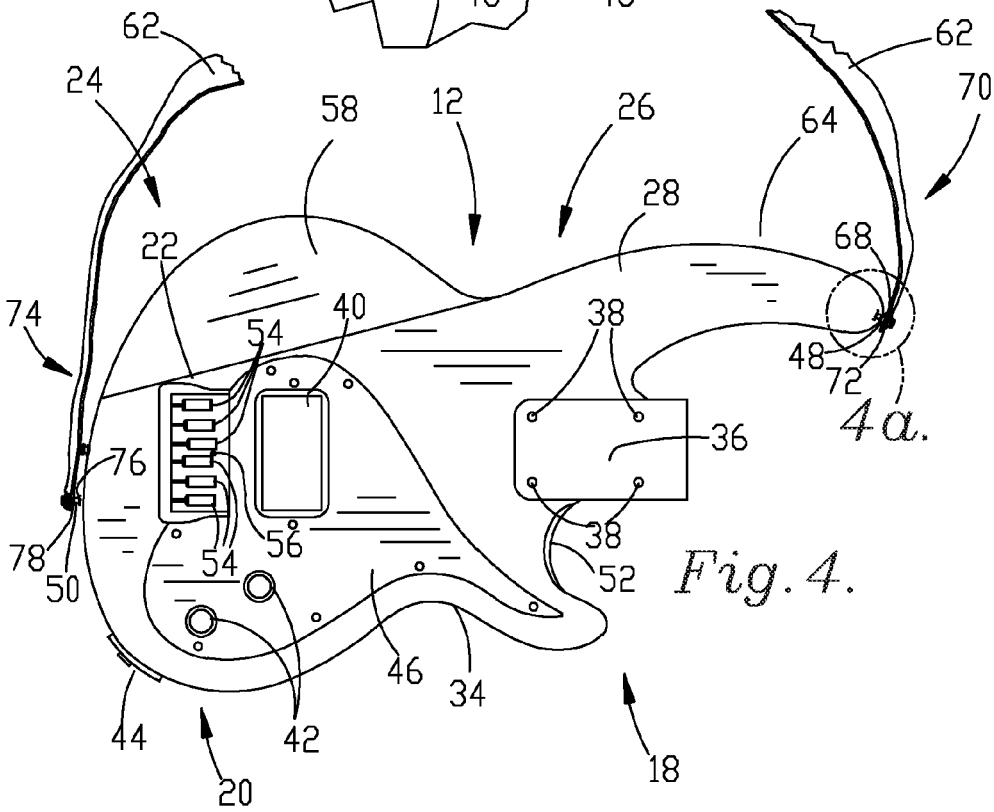
Figure 5:
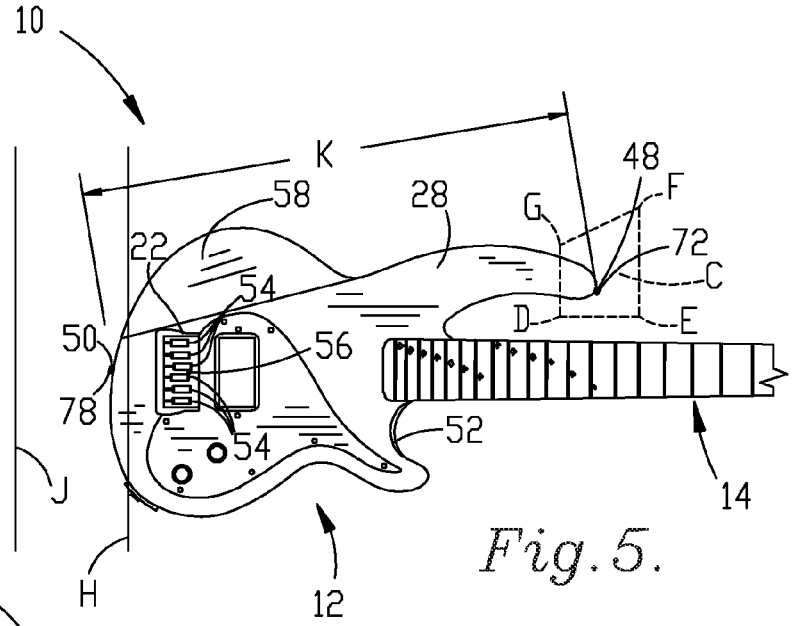
Figure 6:
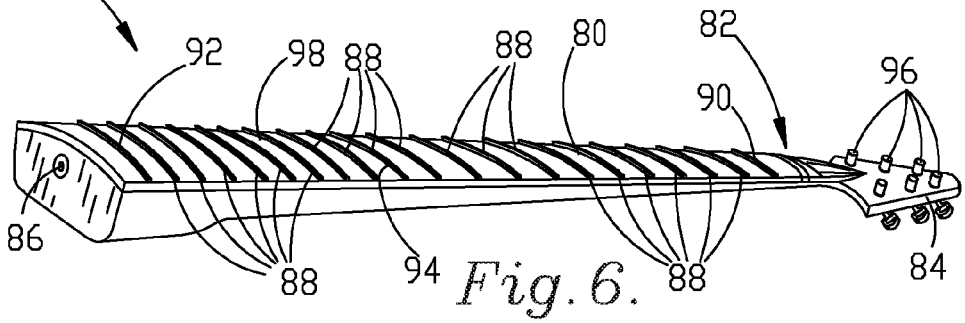
Figure 8:
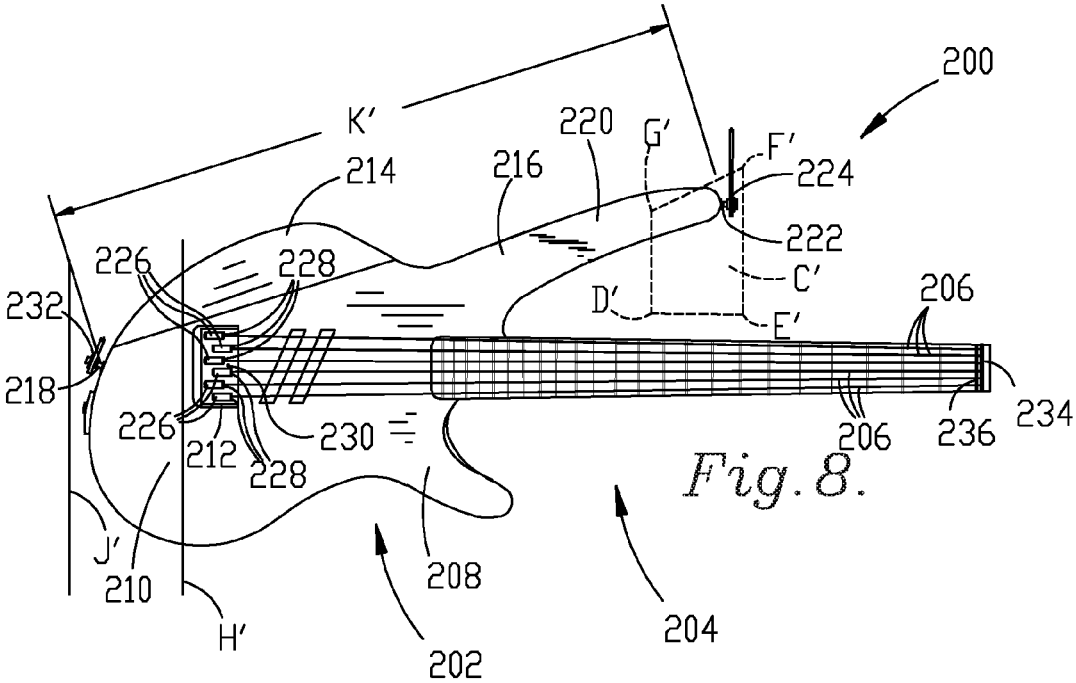

FIG. 4*a* is a partial view of a front strap attachment mechanism of FIG. 4 particularly illustrating region 4*a* of FIG. 4;

FIG. 5 is a front elevational view of the ergonomic guitar of FIG. 1;

FIG. 6 is a perspective view of the neck of the ergonomic guitar of FIG. 1;

FIG. 7 is a partial perspective view of the ergonomic guitar of FIG. 1 particularly illustrating an upper bass bout, a lower bass bout, an arm relief, and a tummy cut; and FIG. 8 is a front elevational view of a second embodiment of an ergonomic guitar.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

For simplicity, references to the position of various components that appear in embodiments of the present invention will be made relative to a guitar with the longitudinal axis of the neck in a horizontal orientation and relative to an observer looking toward the front of the guitar, unless otherwise specified.

Further, references to embodiments contained herein describe an ergonomic guitar designed for a right-handed guitarist wherein the left hand of the guitarist fingers the strings and the guitarist's right hand strums or picks the strings. It should be appreciated, however, that mirroring some or all of the various components described herein further describe an ergonomic guitar designed for a left-handed guitarist and that a left-handed variant is contemplated by, and within the scope of, the present invention. As there is no standard left-handed guitar, some or all of the components of an ergonomic guitar may be mirrored, as needed under the circumstances and as desired by a guitarist.

Guitarists press a string against a fret to determine a string's musical pitch. Most guitars include a body and a neck and are fretted according to a twelve-tone equal-tempered chromatic scale wherein an octave is divided into twelve parts and the pitch of a string held at each fret is one-half step higher than the previous fret, when moving from distal to proximal along the neck toward the body. Most electronic guitars have between 21 and 24 frets and, thus, each string is capable of varying by approximately two octaves. Dividing the length of a vibrating string in half doubles its frequency and raises its pitch by one octave. For simplicity, and because a guitar could be fabricated in nearly any size, references to embodiments of the present invention are made to a guitar having 21 frets that are fretted to a twelve-tone equal-tempered scale. Embodiments of the present invention may include guitars fretted to other scales and with other numbers of frets by adjusting the measurements in proportion to the distance from a nut to a bridge of a guitar. For simplicity, measurements that vary in proportion to scale length will be provided as a percentage of the nut-to-bridge distance, also known as the scale-length, and as a measurement for a particular embodiment. Some distances do not scale proportionally with the scale length of the guitar, however. Those distances will not provide a percentage of the net-to-bridge distance.

To measure improvement in joint stress, references will be made to positions and movements of various joints using standard medical terminology. For reference, these motions are listed below.

Shoulder flexion occurs when raising an arm from a neutral position at the side, through a position where the arm is outstretched in front of the body, to a position alongside the head.

Shoulder extension involves moving from a fully flexed position, through a position where the arm is outstretched in front of the body, to a neutral position at the side of the body and, potentially, continuing behind the body. Shoulder extension is the opposite of shoulder flexion.

Shoulder abduction occurs when raising an arm from a neutral position at the side, through a position where the arm is outstretched laterally at shoulder height, to a position alongside the head.

Shoulder adduction involves moving from a position alongside the head, through a position where the arm is outstretched laterally at shoulder height, to a neutral position at the side of the body. Shoulder adduction is the opposite of shoulder abduction.

Shoulder external rotation is, from a position with the elbow held to the side at shoulder level and bent to a right angle, moving the hand upward so the hand is above the shoulder with the fingers pointing up.

Shoulder internal rotation is, from a position with the elbow held to the side at shoulder level and bent to a right angle, moving the hand downward so the hand is below the shoulder with the fingers pointing down. Shoulder internal rotation is the opposite of shoulder external rotation.

Elbow flexion is bending the elbow to move from a straight position to a bent position with the hand near the shoulder.

Elbow extension is straightening the elbow from a position with the hand near the shoulder to a position with the hand away from the shoulder. Elbow extension is the opposite of elbow flexion.

Wrist flexion is bending the wrist so the fingers move toward the inner aspect of the forearm.

Wrist extension is straightening the wrist from a position where the fingers are near the inner aspect forearm to a position where the fingers are on the same plane as the forearm or beyond. Wrist extension is the opposite of wrist flexion.

Wrist ulnar deviation, or wrist adduction, is bending the wrist laterally from a neutral position toward the pinky, or $5^{th}$ finger, side.

Wrist radial deviation, or wrist abduction, is bending the wrist medially from a neutral position toward the thumb side. This is the opposite as wrist ulnar deviation.

Turning now to the drawing figures and, in particular, FIGS. 1-7, an ergonomic guitar 10 is illustrated and broadly comprises a body 12, a neck 14, and strings 16 for minimizing ergonomic stress on a guitarist's shoulders, back, elbows and wrists when embodiments of the invention are played in a standing position.

As shown best in FIGS. 3-5 and 7, the body 12 provides a central support for the ergonomic guitar 10 and further includes an upper treble bout 18, a lower treble bout 20, a bridge 22, a lower bass bout 24, and an upper bass bout 26, each arranged in a substantially different quadrant of the body 12. The body 12 includes a front face 28, a back face 30, and a side wall 32. In this embodiment, the body 12 is fabricated from wood but, in other embodiments, the body 12 may be fabricated from graphite, carbon fiber, plastic, metal, or the like.

The present embodiment further includes an indentation 34, a neck pocket 36, neck attachment holes 38, a pickup 40, a control knob 42, an input jack 44, a pick guard 46, a front strap attachment mechanism 48, and a rear strap attachment mechanism 50. The indentation 34 enables a guitar to be rested on a thigh or a knee of a seated guitarist and is between the lower treble bout 20 and the upper treble bout 18. The neck pocket 36 provides a secure location for the neck 14 to mount to, and at least partially within, the body 12. The neck pocket 36 is located between the upper bass bout 26 and the upper treble bout 18. The pickup 40 captures electronic vibrations and converts them into an electrical signal and is attached to the front face 28 of the body 12 generally between the lower bass bout 24 and the lower treble bout 20. The control knob 42 controls one of a variety of electronic aspects of the guitar, such as volume, bass sensitivity, treble sensitivity, or the like, and may be rotatably disposed on the front face 28 of the body 12 or even the back face 30 or side wall 32, depending on the circumstances. The input jack 44 facilitates an electrical connection between electronic components of the ergonomic guitar 10, such as the pickup 40, the control knob 42, or the like, and external electronic equipment, such as an amplifier, through a cord, radio-frequency (RF) transmitter, or the like. The input jack may be disposed on the front face 28, the side wall 32, or the back face 30 of the body 12. The pick guard 46 is generally planar and prevents wear and scratching of the body 12 and is attached to the body 12 on its front face 28. The pick guard 46 may be a variety of shapes and may be fabricated from a variety of materials.

The upper treble bout 18 is a quadrant of the body 12 inferior to longitudinal axis of the strings 16 and proximal to the neck 14. In the present embodiment, the upper treble bout 18 further includes a upper treble bout horn and assists in supporting the ergonomic guitar 10 on a knee or a thigh of a seated guitarist without using an additional knee-rest. In the embodiment shown in FIGS. 1-7, the upper treble bout 18 is integrally formed with the body but, in some embodiments, the upper treble bout 18 may be separately formed and attached to the body 12 with screws, bolts, adhesives, or the like. The upper treble bout 18 may be various shapes and fabricated from various materials without deviating from the scope of the invention. The embodiment shown in FIGS. 1-7, the upper treble bout 18 further includes a fingering relief cut 52 for allowing improved access to the proximal portion of the strings 16 by a guitarist's left hand. The fingering relief cut 52 is a bevel at the junction of the front face 28 and side wall 32 of the body 12 near to the neck 14 that allows improved reach of the strings 16 by the guitarist's left hand.

The lower treble bout 20 is a quadrant of the body 12 that extends inferior to longitudinal axis of the strings 16 and distal from the neck 14. In the present embodiment, the lower treble bout 20 assists in supporting the ergonomic guitar 10 on a knee or thigh of a seated guitarist without using an additional knee-rest. In the present embodiment, the lower treble bout 20 is integrally formed with the body 12 but, in some embodiments, the lower treble bout 20 may be separately formed and attached to the body 12 with screws, bolts, adhesives, or the like. The lower treble bout 20 may be various shapes and fabricated from various materials without deviating from the scope of the invention. In some embodiments, the lower treble bout 20 may be shaped to incorporate the control knob 42 or the input jack 44.

The bridge 22 is fixably attached to the front face 28 of the body 12 and anchors the proximal end of the strings 16 to the body 12 of the ergonomic guitar 10. In the embodiment shown in FIGS. 1-7 the bridge 22 is fabricated from metal but, in various other embodiments, the bridge 22 may be fabricated from graphite, active electronic components, or the like. In the present embodiment, the bridge 22 is separately formed from the body 12 and fixed in place with an attachment device such as a screw, bolt, lug, rivet, adhesive, or the like, but, in various other embodiments, the bridge 22 may be integrally formed with the body and, thus, no attachment device is necessary. The bridge 22 defines a plurality of anchor points 54 that define the proximal end of the vibrational length of each of the strings 16. Frequently, the anchor point 54 is similar to a nut or a fret, as discussed below. Because most embodiments of the ergonomic guitar 10 possess a plurality of strings 16, a nominal string anchor point 56 is defined as the average of each of the plurality of anchor points 54 together. Thus, for embodiments of an ergonomic guitar with five strings with the anchor points arranged in a straight line, the anchor point 54 of the middle string is the nominal string anchor point 56. For an embodiment with two strings, the nominal string anchor point 56 would a midpoint of a line connecting each of the anchor points 54. In some embodiments, the bridge 22 may include a tailpiece.

The lower bass bout 24 is a quadrant that extends superior to the longitudinal axis of the strings 16 and distal from the neck 14 for supporting the guitarist's right arm in a variety of playing positions and further includes an arm relief 58. In the present embodiment, the lower bass bout 24 is integrally formed with the body 12 but, in some embodiments, the lower bass bout 24 may be separately formed and attached to the body 12 with screws, bolts, adhesives, or the like. The lower bass bout 24 may be various shapes and fabricated from various materials without deviating from the scope of the invention. In the present embodiment, the lower bass bout 24 is reduced in size relative to conventional guitars but still supports a guitarist's right arm by extending fully beyond reference arc Az.

Figure 3:
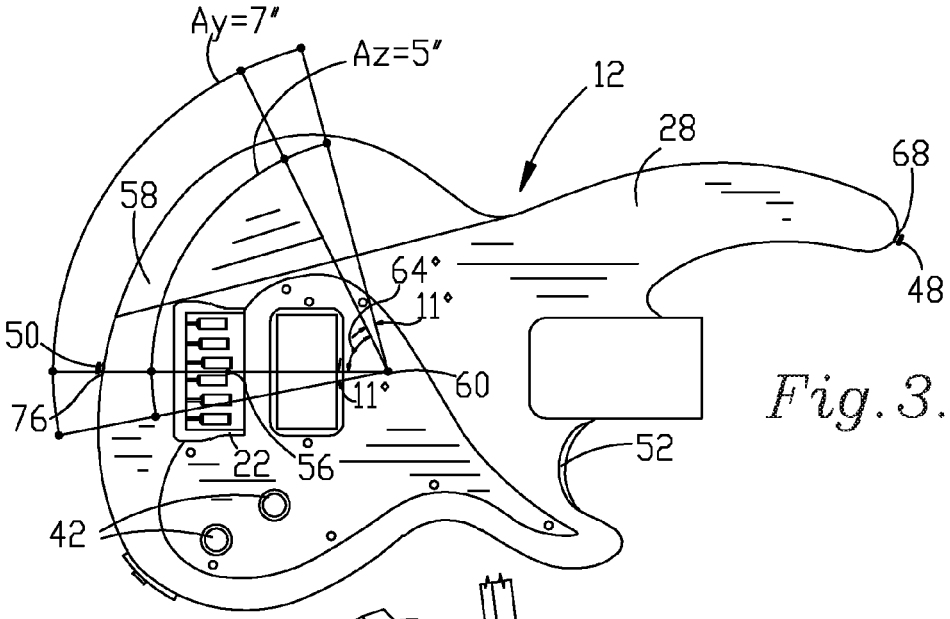
FIG. 3 is a front elevational view of the ergonomic guitar body of FIG. 1.

As shown in FIG. 3, reference arc Az has a 12.7 cm (5 in) radius with its center 60 7.62 cm (3 in) from the nominal string anchor point 56, along the major axis of the strings 16 toward the neck 14. The reference arc Az begins along the major axis of the strings 16 in a direction opposite the neck 14, between the lower bass bout 24 and the lower treble bout 20, and continues 64 degrees clockwise, as seen from the front face 28 of the body 12. The reference arc Az is further extended approximately 11.4 degrees at both ends.

Reference arc Ay has a 17.78 cm (7 in) radius with its center 60 7.62 cm (3 in) from the nominal string anchor point 56, along the major axis of the strings 16 toward the neck. The reference arc Ay begins along the major axis of the strings 16 in a direction opposite the neck 14, between the lower bass bout 24 and the lower treble bout 20, and continues 64 degrees clockwise, as seen from the front face 28 of the body 12. The reference arc Ay is further extended approximately 11.4 degrees at both ends.

Taken together, reference arc Az and reference arc Ay define a region for the side wall 32 of the lower bass bout 24 that provides right arm support through a range of motion while remaining small enough to reduce ergonomic stress on the left shoulder. When the lower bass bout 24 extends beyond reference arc Az, it provides support for the right wrist of the guitarist through a range of playing angles. In embodiments where a range of playing angles is not required, the lower bass bout 24 may extend beyond reference arc Az in only a portion of the lower bass bout 24. When the lower bass bout 24 does not extend beyond reference arc Ay, its reduced size provides an ergonomic benefit by reducing the weight of the ergonomic guitar 10 and, thus, stress on multiple joints including the guitarist's right shoulder and back.

In the present embodiment, the arm relief 58 is a generally wedge-shaped region disposed between a medial portion of the front face 28 and the side wall 32 of the body 12 for enabling a more comfortable playing position for the guitarist's right arm. In this embodiment, the arm relief 58 is integrally formed with the lower bass bout 24 and the body 12 but, in other embodiments, the arm relief may be separately formed and attached to the lower bass bout 24 with a fastener such as screws, bolts, lugs, adhesives, or the like. In this embodiment the arm relief 58 is wedge-shaped but, in other embodiments, the arm relief 58 may be rounded, flat, concave, convex, scalloped, or combinations thereof, or the like.

The upper bass bout 26 is the quadrant of the body 12 that extends superior to the longitudinal axis of the strings 16 and proximal from the neck 14 for balancing the ergonomic guitar 10 and providing an attachment point for the strap 62. In the embodiment shown in FIGS. 1-7, the upper bass bout 26 further includes a horn 64 and a tummy cut 66. In this embodiment, the horn 64 further includes a front hole 68 for securing the front strap attachment mechanism 48 with a fastener such as a screw, pin, bolt, adhesive, or the like.

In some embodiments, the horn 64 provides at least 3.7 cm (1.46 inches) of space between its inner aspect and the nearest edge of the neck 14 up to the $15^{th}$ fret to provide clearance for the guitarist's left thumb. In embodiments designed for children, 3.5 cm (1.38 in) of space may be provided up to the $15^{th}$ fret. The tummy cut 66 is a beveled region disposed between the back face 30 and the side wall 32 of the body 12 for conforming to the shape of a belly of the guitarist while playing. Thus, embodiments of the ergonomic guitar 10 that include the tummy cut 66 can be held closer to the body than embodiments without it.

Turning now to FIGS. 4 and 4*a*, the front strap attachment mechanism 48 removably attaches a front end 70 of the strap 62 to the various locations on the body 12 including the horn 64 of the upper bass bout 26. In some embodiments, the front strap attachment mechanism 48 may be a fixably-attached strap button, straplock, or the like. In the embodiment shown in FIGS. 1-7, a strap lock is used and installed within the front hole 68 with a fastener such as a screw, pin, bolt, adhesive, or the like. Because some strap locks hold a strap approximately 0.7 cm (0.28 in) along its longitudinal axis from a guitar body when installed therein, the front strap attachment point 72 is approximately 0.7 cm (0.28 in) from the rear hole 76. In some embodiments, a conventional 0.625 cm (0.25 in) strap button is used. Because conventional 0.625 cm (0.25 in) strap buttons are approximately 0.625 cm along their longitudinal axis and the strap 62 rests in generally the middle of a strap button, the front strap attachment point 72 is approximately 0.3125 cm (0.125 in) from the front hole 68 where the front strap attachment mechanism 48 attaches when the front strap attachment mechanism 48 is installed within the front hole 68. In other embodiments, the front strap attachment mechanism 48 may attached directly to body 12 with a fastener and, in yet other embodiments, the front strap attachment mechanism 48 is integrally formed with the body 12 and, thus, no fastener is necessary.

As shown in FIG. 5, in some embodiments, the front strap attachment mechanism 48 is positioned so the front strap attachment point is within reference region C defined by first corner D, second corner E, third corner F, and fourth corner G. The region C allows 3.7 cm (1.46 in) between the proximal edge of the neck 14 and the proximal edge of region C defined by first corner D and second corner E. The width of a typical electric guitar neck is 5.1 cm (2.0 in) midway between the $10^{th}$ and $11^{th}$ fret and 4.8 cm (1.89 in) at the $7^{th}$ fret. Thus, the distance to the midline of the neck 14 is 2.55 cm (1.00 in) midway between the $10^{th}$ and $11^{th}$ fret and 2.4 cm (0.94 in) at the $7^{th}$ fret. First corner D lies along a line 54.545% of the scale length from the bridge 22 end of the strings 16 (midway between a $10^{th}$ and an $11^{th}$ fret on a conventionally fretted guitar), and extending perpendicular to and 6.25 cm (2.46 in) superior from the midline of the longitudinal axis of the neck 14. Thus, first corner D allows 3.7 cm (1.46 in) of clearance to the neck and 2.55 cm to the midline of the neck 14. Similarly, second corner E lies along a line originating at 66.74% of the scale length from the bridge 22 end of the strings 16 (at the $7^{th}$ fret in conventionally fretted guitar), and extending perpendicular to and 6.1 cm (2.40 in) superior from the midline of the longitudinal axis of the neck 14. Thus, second corner E allows 3.7 cm (1.46 in) of clearance to the neck and 2.4 cm to the midline of the neck 14. Third corner F lies along a line originating at 66.74% of the scale length from the bridge 22 end of the strings 16 (at the $7^{th}$ fret in conventionally fretted guitar), and extending perpendicular to and extending perpendicular to 15.24 cm (6 in) superior from the midline of the longitudinal axis of the neck 14. Finally, fourth corner G lies along a line 54.545% of the scale length from the bridge 22 end of the strings 16 (midway between a $10^{th}$ and an $11^{th}$ fret on a conventionally fretted guitar), and extending perpendicular to and 11.43 cm (4.5 in) superior from the midline of the longitudinal axis of the neck 14.

Referring again to FIG. 4, the rear strap attachment mechanism 50 removably attaches a rear end 74 of the strap 62 to the body 12 in a variety of locations including the lower bass bout 24 or lower treble bout 20. In some embodiments, the rear strap attachment mechanism 50 may be a fixably-attached strap button, straplock, or the like. In the embodiment shown in FIGS. 1-7, a strap lock is used and installed within the rear hole 76 with a fastener such as a screw, pin, bolt, adhesive, or the like. Because some strap locks hold a strap approximately 0.7 cm (0.28 in) along its longitudinal axis from a guitar body when installed therein, the rear strap attachment point 78 is approximately 0.7 cm (0.28 in) from the rear hole 76. In some embodiments, a conventional 0.625 cm (0.25 in) strap button may be used. Because conventional 0.625 cm (0.25 in) strap buttons are approximately 0.625 cm along their longitudinal axis and the strap 62 rests in generally the middle of a strap button, in embodiments where a strap button is used, the rear strap attachment point 78 is approximately 0.3125 cm (0.125 in) from the rear hole 76 where the rear strap attachment mechanism 50 attaches when the rear strap attachment mechanism 50 is installed within the rear hole 76. In other embodiments, the rear strap attachment mechanism 50 may attached directly to the body 12 with a fastener and, in yet other embodiments, the rear strap attachment mechanism 50 integrally formed with the body 12 and, thus, no fastener is necessary.

Looking again at FIG. 5, in some embodiments, the rear strap attachment mechanism 50 is positioned so the rear strap attachment point 78 is between a first reference line H and a second reference line J. The first reference line H is perpendicular to the major axis of the strings 16 and passes through major axis of the strings 16 10% of the scale length (6.35 cm/2.5 in in a 63.5 cm/25 in scale-length guitar) from the nominal string anchor point 56 in a direction opposite the neck 14. The second reference line J extends parallel to the first reference line H and is offset 7.64% of the scale length (4.85 cm/1.91 in in a 63.5 cm/25 in scale-length guitar) from the first reference line H in a direction opposite the neck 14. Thus, the second reference line J is perpendicular to the major axis of the strings 16 and passes through the major axis of the strings 17.64% of the scale length (11.20 cm/4.41 in in a 63.5 cm/25 in scale-length guitar) from the nominal string anchor point 56 in a direction opposite the neck. For comparison, a location of a rear strap attachment point relative to an average of the string contact points in a prior art guitar ranges from approximately 24% of the scale-length (15.24 cm/6 in on a 63.5 cm/25 inch scale-length guitar) to approximately 32% of the scale length (20.32 cm/8 in on a 63.5 cm/25 inch scale-length guitar) in various models or, for reference, less than 9% on standard bass guitars.

Additionally, in some embodiments, the straight line distance K between the front strap attachment point 72 and the rear strap attachment point 78 is less than or equal to 50.8 cm (20 in), as described in more detail below.

As best shown in FIG. 6, the neck 14 supports and positions the strings and further includes a fingerboard 80, a nut 82, a headstock 84 and, in some embodiments, a truss rod 86. The neck 14 described herein is substantially conventional and may be fabricated from wood, metal, fiberglass, carbon fiber, combinations thereof, or the like.

The fingerboard 80 provides a smooth fingering surface, directly underlies the strings 16 and, in some embodiments, includes a fret 88 fixably disposed thereon. In various embodiments, the fingerboard 80 may be fabricated from the same material or a different material than the neck 14. In some embodiments, the fingerboard 80 is separately formed from the neck 14 and attached thereto with a fastener such as adhesives, screws, nuts, bolts, lugs, staples, or the like, to form a unitary whole. In other embodiments, the fingerboard 80 is fabricated as an integral part of the neck 14 and, thus, no fastener is necessary.

Each fret 88 is a thin elongated rod fixably disposed on the fingering surface of the fingerboard 80 for shortening each of the strings 16 to produce a change in a pitch created by each of the strings 16 by limiting its vibrating length. The fret 88 may be fabricated from metal, wood, plastic, resin, or other material capable of limiting the vibrating length of the string. In some embodiments, the fret 88 may even extend beyond the fingerboard 80 and wrap, like a band, around the neck 14.

By convention in the art, the first fret 90 is closest to the nut 82 and the twenty-first fret 92 is closest to the bridge 22. The twelfth fret 94 is equidistant between the nut 82 and the bridge 22 and, thus, holding a string at the twelfth fret 94 raises the pitch of the string by one octave. Likewise, a twenty-fourth fret would be equidistant between the twelfth fret 94 and the bridge 22 and holding a string at the twenty-fourth fret would raise the pitch of a string by two octaves.

The nut 82 is an elongated rod fixably disposed on the fingering surface of the fingerboard 80 sets a baseline vibrational length for the strings 16. In some embodiments, the nut 82 includes indentations on a string side for aligning each string 16 and providing a fixed spacing between each string 16. In some embodiments, the nut 82 may be replaced or supplemented by a fret 88 in the same location and commonly referred to as a zero-fret. It should be understood that the nut 82 may be substituted with a zero-fret without deviating from the scope of the invention.

The headstock 84 lies at the distal end of the neck 14 and anchors the strings 16 to the neck 14. In some embodiments, the headstock 84 further includes a plurality of tuners 96 to independently adjust the tension on each of the strings 16. In the embodiment shown in FIGS. 1-7, the headstock 84 is fabricated from a single piece of wood with the neck but, in other embodiments, the headstock 84 may be separately formed from the neck 14 and attached with an fastener such as screws, pins, bolts, adhesive, a combination thereof, or the like.

The truss rod 86 is a rod that extends through a longitudinal cavity within the neck 14 for counteracting tension from the strings 16.

In use, embodiments of the ergonomic guitar 10 reduce stress on the back of the guitarist, balance comfortably on the strap 62, provide support for the right arm of the guitarist, continue to support the right arm while the playing angle is changed, and allow comfortable fingering or chording up the fingerboard 80 to 29.7% of the distance from the nominal string anchor point 56 (the 21st fret) by providing left thumb access to the lateral fingerboard to at least 39.7% of the distance from the nominal string anchor point 56 (at or above the 16th fret 98) and by providing the fingering relief cut 52. Additionally, embodiments of the ergonomic guitar 10 reduce joint angles in the left shoulder, left elbow, left wrist, right shoulder, right elbow, and right wrist. These benefits are obtained while the guitarist plays embodiments of the ergonomic guitar 10 in a substantially conventional manner.

Guitarists generally play with the guitar at an angle between 0 degrees, wherein the neck 14 is generally parallel with the horizon, and 64 degrees, wherein the neck 14 is raised generally 64 degrees above the horizon, relative to the body 12. In particular, guitarists commonly play between the angles of 0 and 64 degrees with many clustered around the middle of that range at approximately 32 degrees. Additionally, many guitarists will vary the playing angle during a performance.

Embodiments of the ergonomic guitar 10 reduce the overall weight and, therefore, less stress is placed on the left shoulder of the guitarist by way of the strap 62. Thus, less weight must be supported the guitarist's back that, in turn, reduces stress and fatigue.

Embodiments of the ergonomic guitar 10 balance comfortably on the strap 62 whereas the natural balance of most lightweight-bodied prior art guitars exerts a downward force on the neck of the guitar that tends to decrease the playing angle. That is, prior art guitars tend to droop which is commonly called "neck dive." As previously discussed, one solution to neck dive is relocating the tuners from the headstock of the prior art guitar to the bridge. Some embodiments of the present invention may use bridge tuners in addition to the improvements described herein, such as the embodiment described with reference to FIG. 8, below.

Embodiments of the ergonomic guitar 10 balance comfortably on the strap 62 by positioning the front strap attachment point 72 and rear strap attachment point 78 appropriately relative to the body 12 and the neck 14 and relative to each other. In particular, by locating the front strap attachment point 72 within reference region C and the rear strap attachment point 78 between first reference line H and second reference line J, the ergonomic guitar 10 balances stably on a strap while using substantially conventional tuners and strings. Additionally, in all guitars, when the distance between the front strap attachment point and the rear strap attachment point of a guitar is greater than approximately 50.8 cm (20 in), the guitar can become difficult to balance, unstable, and "wobbly," particularly at playing angles of greater than 60 degrees. Thus, in some embodiments, the distance between the front strap attachment point 72 and the rear strap attachment point 78 is less than 50.8 cm (20 in).

Embodiments of the ergonomic guitar also support the guitarist's right arm and even enable the guitarist to alter the playing angle during a performance without losing right arm support at any point in the alteration. When the guitarist is playing the ergonomic guitar 10 the lower bass bout 24 is sufficiently large to support the guitarist's right hand through the various possible playing angles from 0 to 64 degrees by extending beyond reference arc Az. The lower bass bout 25 is also reduced in size to reduce ergonomic stress on the guitarist by not extending beyond reference arc Ay. The front face 28 of the ergonomic guitar 10 is also easily positioned more closely to the guitarist's body by providing the tummy cut 66 and the arm relief 58 allows the right arm of the guitarist to remain closer to its natural resting position reducing stress on the guitarist's right shoulder caused from excess flexion, abduction, and internal rotation.

By constructing the arm relief 58 substantially outside the reference arc Az, the lower bass bout 24 supports the strumming-arm of the guitarist through the standard angles of 0 to 64 degrees. But by reducing the size of the lower bass bout 24 to within reference arc Ay, in comparison to prior art guitars, right shoulder internal rotation and right wrist flexion are reduced.

Embodiments of the ergonomic guitar 10 reduce joint angles and stress significantly. As measured by an orthopedic surgeon, embodiments of the ergonomic guitar 10 reduce joint angles on a 175 cm (5 ft 9 in) guitarist as shown:

| | Prior Art Joint Angle | | Joint Angle | |
|---|---|---|---|---|
| Joint Movement | High (degrees) | Low (degrees) | Embodiments (degrees) | Improvement (Reduction) |
| | | Left Shoulder | | |
| External Rotation | 20 | 11 | 5 | 120%-300% |
| Abduction | 20 | 15 | 10 | 50%-100% |
| Flexion | 25 | 20 | 8 | 150%-200% |
| | | Left Elbow | | |
| Extension | 125 | 112 | 105 | 7%-19% |
| | | Left Wrist | | |
| Palmar Flexion | 20 | 14 | 4 | 250%-400% |
| Ulnar Deviation | 36 | 25 | 17 | 45%-110% |
| | | Right Shoulder | | |
| Internal Rotation | 49 | 47 | 10 | 370%-390% |
| Abduction | 35 | 42 | 15 | 133%-180% |
| Flexion | 16 | 10 | −16 (Extension) | Yes |
| | | Right Wrist | | |
| Flexion | 35 | 26 | 21 | 24%-67% |

Right shoulder extension provides a more natural, and comfortable, position for the arm with the elbow flexed.

Turning now to FIG. 8, another embodiment of an ergonomic guitar 200 is shown. This embodiment is substantially similar to the embodiment shown and described with reference to FIGS. 1-7, except as specified. In this embodiment, the ergonomic guitar broadly comprises a body 202, a neck 204, and a string 206.

The body 202 broadly includes an upper treble bout 208, a lower treble bout 210, a bridge 212, a lower bass bout 214, and an upper bass bout 216. The body also includes a rear strap attachment mechanism 218.

The upper bass bout 216 includes a horn 220 and a front strap attachment mechanism 222 disposed on a distal end of the horn 220. In this embodiment, the front strap attachment point 224 disposed within region B' that is defined by first corner D', second corner E', third corner F', and fourth corner G' that correspond generally to first corner D, second corner E, third corner F, and fourth corner G, of FIGS. 1-7. In this embodiment, the front strap attachment mechanism 222 is substantially near third corner F'.

In this embodiment, the bridge 212 anchors the proximal end of each string 206 and includes a tuner 226 for each string 206 and an anchor point 228 that defines the proximal end of the vibrational length of each string 206. As discussed in reference to FIGS. 1-7, the nominal string anchor point 230 is the average of each anchor point 228.

In this embodiment, the rear strap attachment mechanism 218 is disposed on the lower bass bout 214, above the major axis of the strings 206 when played at a zero-degree angle, and so the rear strap attachment point 232 is between first reference line H' and second reference line J'. First reference line H' and second reference line J' correspond generally to first reference line H and second reference line J of FIGS. 1-7, respectively. In this embodiment, the rear strap attachment point 232 is substantially near reference line H'.

In this embodiment, the neck 204 includes a headpiece 234 and a zero-fret 236. The headpiece 234 removably secures the each string 206 at the distal end of the neck. The zero-fret 236 defines the distal end of the vibrating length of each string 206.

Although the invention has been described with reference to the preferred embodiment illustrated in the attached drawing figures, it is noted that equivalents may be employed and substitutions made herein without departing from the scope of the invention as recited in the claims.

What is claimed is:

1. An ergonomic guitar having a determined scale-length, a neck including a plurality of frets, a longitudinal axis of the neck being parallel to a first axis;

a plurality of strings extending substantially parallel to the first axis; and a body further including:

a bridge disposed on the body and having a nominal string anchor point for the strings;

an upper bass bout including a horn and a front strap attachment mechanism disposed on the horn, the front strap attachment mechanism having a front strap attachment point, the front strap attachment point disposed within a region bounded by:

a first corner 4.6 cm superior to the first axis along a second axis and 54.545% of the scale-length in a first direction of the first axis, a second corner 4.6 cm superior to the first axis along a third axis and 66.74% of the scale-length in a first direction of the first axis, a third corner 15.24 cm superior to the first axis along the third axis and 66.74% of the scale-length in a first direction of the first axis, a fourth corner 11.43 cm superior to the first axis along the second axis and 54.545% of the scale-length in a first direction of the first axis, a rear strap attachment mechanism having a rear strap attachment point, the rear strap attachment point disposed between 10% of the scale length and 17.64% of the scale length from the nominal string anchor point measured along a second direction of the first axis a lower bass bout including a generally wedge-shaped region disposed between a medial portion of a front face of the lower bass bout and extending to a peripheral side wall of the lower bass bout, wherein the lower bass bout extends substantially beyond a first arc having a radius of 12.7 cm and a center 3 cm from the nominal string anchor point along the first direction of the first axis, the first arc extending 11.4 degrees counter-clockwise from the first axis along the second direction to 75.4 degrees clockwise from the first axis along the second direction, and wherein the lower bass bout is substantially within a second arc having a radius of 17.78 cm and a center 3 cm from the nominal string anchor point along the first direction of the first axis, the first arc extending 11.4 degrees counter-clockwise from the first axis along the second direction to 75.4 degrees clockwise from the first axis along the second direction, wherein the neck is disposed on an edge of the body, wherein the strings extend in a first direction from the bridge to a distal portion of the neck, wherein the second axis is perpendicular to the first axis, wherein the third axis is parallel to the second axis, wherein a distance between the front strap attachment point and the rear strap attachment point is less than 50.8 cm, and wherein the scale-length is between 55.88 cm and 66.04 cm.

2. The ergonomic electric guitar of claim 1, wherein the body is fabricated from wood.

3. The ergonomic electric guitar of claim 1, wherein the scale-length is between 62.48 cm and 65.02 cm.

* * * * *